US010082264B2

(12) United States Patent
Hossfeld

(10) Patent No.: US 10,082,264 B2
(45) Date of Patent: Sep. 25, 2018

(54) LIGHT MODULE FOR MOTOR VEHICLE HEADLIGHTS

(71) Applicant: Automotive Lighting Reutlingen GmbH, Reutlingen (DE)

(72) Inventor: Wolfgang Hossfeld, Gomaringen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 0 days.

(21) Appl. No.: 15/853,162

(22) Filed: Dec. 22, 2017

(65) Prior Publication Data

US 2018/0187851 A1 Jul. 5, 2018

(30) Foreign Application Priority Data

Dec. 29, 2016 (DE) ..... 10 2016 125 887

(51) Int. Cl.
*F21V 5/00* (2018.01)
*F21S 41/20* (2018.01)
(Continued)

(52) U.S. Cl.
CPC ..... *F21S 41/285* (2018.01); *F21S 41/141* (2018.01); *F21S 41/25* (2018.01); *F21S 41/40* (2018.01);
(Continued)

(58) Field of Classification Search
CPC ..... F21S 41/285; F21S 41/25; F21S 41/663; F21S 41/40; F21S 45/48; F21S 41/141; F21Y 2105/14; F21Y 2115/10
See application file for complete search history.

(56) References Cited

U.S. PATENT DOCUMENTS 6,948,836 B2 9/2005 Ishida et al.
8,733,992 B2 * 5/2014 Bushre ..... B60Q 1/20 362/520
(Continued)

FOREIGN PATENT DOCUMENTS

DE 102008036192 A1 2/2010
DE 102009010558 A1 8/2010
(Continued)

OTHER PUBLICATIONS

Examination Report dated Jul. 7, 2017 for German Patent Application No. 10 2016 125 887.3.
(Continued)

*Primary Examiner* — Seung Lee
(74) *Attorney, Agent, or Firm* — Howard & Howard Attorneys PLLC

(57) ABSTRACT

A light module for a motor vehicle headlight with at least two semi-conductor light sources, a light decoupling optical system having at least one partial optical element and a diaphragm. The light module includes a lens combination arranged between the light decoupling optical system and the diaphragm, which is illuminated by at least one of the two semi-conductor light sources, wherein the lens combination has different refractivities in two spatial directions perpendicular to one another and to the main propagation direction of the emitted light. The light decoupling optical system has different refractivities in the two spatial directions, wherein the refractivity of the light decoupling optical system is greater in the spatial direction in which the lens combination has a lesser refractivity.

20 Claims, 14 Drawing Sheets

(51) Int. Cl.

| | |
|---|---|
| ***F21S 45/48*** | (2018.01) |
| ***F21S 41/40*** | (2018.01) |
| ***F21S 41/141*** | (2018.01) |
| ***F21S 41/663*** | (2018.01) |
| ***F21S 41/25*** | (2018.01) |
| *F21Y 115/10* | (2016.01) |
| *F21Y 105/14* | (2016.01) |

(52) U.S. Cl.
CPC ..... *F21S 41/663* (2018.01); *F21S 45/48* (2018.01); *F21Y 2105/14* (2016.08); *F21Y 2115/10* (2016.08)

(56) References Cited

U.S. PATENT DOCUMENTS

| | | | | |
|---|---|---|---|---|
| 9,157,597 | B2 * | 10/2015 | Gurtl | F21S 41/143 |
| 9,243,771 | B2 * | 1/2016 | Jungwirth | F21S 41/143 |
| 9,915,405 | B2 * | 3/2018 | Maier | F21S 41/24 |
| 2010/0226144 | A1 | 9/2010 | Stade et al. | |
| 2013/0094234 | A1 | 4/2013 | Kloos | |
| 2016/0039330 | A1 * | 2/2016 | Rosenhahn | B60Q 1/06 362/512 |
| 2017/0350568 | A1 | 12/2017 | Hager et al. | |

FOREIGN PATENT DOCUMENTS

| | | | |
|---|---|---|---|
| DE | 102011054232 | A1 | 4/2013 |
| DE | 102013110272 | A1 | 3/2015 |
| DE | 102014203313 | A1 | 8/2015 |
| DE | 102014226650 | A1 | 6/2016 |
| EP | 1306607 | A2 | 5/2003 |
| EP | 2602539 | A1 | 6/2013 |
| EP | 3163155 | A1 | 5/2017 |
| JP | S6340201 | A | 2/1988 |

OTHER PUBLICATIONS

Office Communication for European Patent Application No. 17205636.8 dated May 14, 2018.

* cited by examiner

LIGHT MODULE FOR MOTOR VEHICLE HEADLIGHTS

CROSS-REFERENCE TO RELATED APPLICATIONS

The present application claims priority to and all the benefits of German Patent Application No. 10 2016 125 887.3, filed on Dec. 29, 2016, which is hereby expressly incorporated herein by reference in its entirety.

BACKGROUND OF THE INVENTION

1. Field of the Invention

The present application relates to a light module for a motor vehicle headlight.

2. Description of the Related Art

Such a light module is known per se and has at least two semi-conductor light sources, one for each custom auxiliary optical system for every semi-conductor light source, a light decoupling optical system having at least one partial optical element and a diaphragm arranged between the auxiliary optical system and the light decoupling optical system, wherein the light module generates at least two different light distributions compliant to the rules, in each case individually or in any combination.

From DE 10 2014 226 650 A1 a luminaire is known which realizes the at least three light functions such as e.g. passing light, high beam, daytime running light and/or navigation light. In the process, the passing light is generated analogous to the description in U.S. Pat. No. 6,948,836 and the high beam and daytime running light are generated in similar manner to DE 10 2008 036 192.

U.S. Pat. No. 6,948,836 discloses a passing light module, which generates a light/dark boundary through an approximately horizontal mirrored diaphragm. The light used for generating a passing light distribution is generated by a semi-conductor light source and collimated by a reflector. The collimated light is directed from above onto the front diaphragm edge. An image of the diaphragm edge is projected by a light decoupling optical system realized as a projection lens as a light/dark boundary of a passing light distribution onto the street. Location information such as above and below in this application always relates to an orientation of the light module, which corresponds to its orientation in the case of appropriate use in a motor vehicle.

From DE 10 2008 036 192 A1 an LED bi-function module for the generation of a passing light- and high beam distribution of a motor vehicle headlight is known. The horizontal diaphragm is designed thin here and is additionally illuminated from below for the generation of the high beam light portion. Reflectors or catadioptric optical systems are used for the collimation of the LED light.

SUMMARY OF THE INVENTION

Proceeding from the initially described prior art, the invention addresses the problem of building the most compact possible light module with which at least two light distributions compliant to the rules can be generated. The two light distributions are preferably a passing light distribution and a high beam distribution. Simultaneously, however the light module should be designed as simply as possible.

The present invention is directed toward a light module for a motor vehicle including a lens combination is arranged between the light decoupling optical system and the diaphragm which is illuminated by at least one of the at least two semi-conductor light sources and from which light of this semi-conductor light source is emitted in a light beam. The lens combination possesses a different refractivity in two spatial directions perpendicular to one another and to the main propagation direction of the light emitted from the light module and that the light decoupling optical system, which is arranged in the light beam of the lens combination, possesses a different refractivity in two spatial directions perpendicular to one another and to the main propagation direction of the light emitted from the light module. The refractivity of the light decoupling optical system is greater in the spatial direction in which the lens combination has the lesser of its two refractivities and wherein the lens combination is arranged closer to the diaphragm than to the light decoupling optical system.

The lens combination can also consist of a number of individual lenses. The number of lenses preferably corresponds to the number of auxiliary optical systems. Each lens, or each part of the lens combination, is preferably in the light beam is assigned to precisely one auxiliary optical system and is illuminated with the light of a light source. The individual lenses are arranged in a series perpendicular to the main direction of light propagation. The light decoupling optical system consists of a single lens assigned to all individual lenses.

One pair each of the lens from an auxiliary optical system and the lens lying in the light beam of this auxiliary optical system, or of the part of the lens combination lying in the light beam of this auxiliary optical system and the subsequent light decoupling optical system in the light path, form a light channel. The different light channels run between auxiliary optical system and lens, or part of the lens combination separately from one another. The two light distributions can also be part of a single light distribution compliant to the rules, for example of a passing light distribution or of a high beam distribution, wherein the individual channels only generate different partial light distributions. Then the diaphragm has only a continuous form or can, in the case of a high beam distribution, also be absent. The lens combination together with the light decoupling optical system forms a projection lens system, wherein each lenticular part of the lens combination together with the light decoupling optical system performs the function of a light channel-individual projection lens. The auxiliary optical system-side focal distances of these light channel-individual projection lenses are greater for the high beam channels than for the passing light channels.

In particular for the generation of high beam and passing light, there are guidelines from lawmakers and automobile manufacturers as to which angular regions should be illuminated. As a rule, the angular regions in horizontal and vertical direction differ in size. In the case of passing light it can in the process be a matter of a ratio of 5:1 (approx. 100° horizontal width, approx. 20° vertical height). If such a ratio is already supposed to be generated in an intermediate image surface on the diaphragm edge, the width of the diaphragm must also be correspondingly large. Accordingly, light modules must have a certain size, in order to generate such a light distribution. If several light sources are generated for the generation of a light distribution compliant to the rules or several different light functions are realized in one module, this will lead to the result that the overall system has to be larger, which is an obstacle to a compact solution.

As a result of the fact that the lens combination and the light decoupling optical system have a different refractivity in different spatial directions, a distorted image is generated, which solves this problem. The lens combination (or the lenses), which is arranged after a diaphragm that may be present in the light path, depending on the guideline provides for a more or less heavy concentration in the one direction, while the light decoupling optical system realizes this for a second direction. Preferably, the lens combination first and foremost provides for a concentration in the spatial direction, in which a greater angular region should be illuminated. The concentration in the other spatial direction is primarily realized by the light decoupling optical system. This second concentration essentially causes a parallelization of the light beams.

In the case of a front headlight, the spatial directions in the case of appropriate use of the front headlight are a vertical spatial direction and a horizontal spatial direction. The lens combination preferably concentrates in the horizontal, while the light decoupling optical system preferably concentrates in the vertical. Moreover, for the compactness of the light module it is advantageous if the lens combination (or the lenses performing its optical function) is located close to the intermediate image surface, this means close to the side or edge of the diaphragm facing the light emission optical system. The reason for this is that the auxiliary optical systems as a rule are designed such that the light concentrations of the individual light sources there are most closely collimated. In particular, it is preferred that the lens combination (or the lenses performing its optical function), is located more closely to the side or edge of the diaphragm facing the light emission optical system than on the light emission optical system. The lens combination (or the lenses performing its optical function) preferably lies in the light path between the edge of the diaphragm and the light emission optical system.

As a result of this optical concept the light module has a simple and simultaneously compact structure.

More specifically, the number of components is low (preferably, but not necessarily less than 12 components per module, not counting light sources and attachments such as screws), that no mechanical movable parts are required for the generation of the different light distributions, and that all components can be produced with conventional manufacturing methods cost-effectively and in large numbers.

In one embodiment, the module may have a height of less than 75 mm, a depth of less than 130 mm and a width of less than 150 mm.

In one embodiment, light emitted from the light module is a passing light and/or high beam and/or daytime running light and/or navigation light and/or blinking light and/or bending light and/or motorway light and/or town light and/or partial high beam and/or marking light compliant to the rules, wherein to this end the light module should be able to generate at least two of these light distributions, conceivably also for different traffic types (left-hand traffic, right-hand traffic) or regulation variants (ECE (Europe), SAE (USA), CCC (China)). Of course this list is not restricted to the mentioned light distributions, but rather can also include additional light distributions.

It is further preferred that the light emission optical system has a further partial optical element and that the auxiliary optical system of at least one of the semi-conductor light sources directs light of this semi-conductor light source past the lens combination to the further partial optical element and that the further partial optical element generates a light distribution which is different from the light distributions of the light which is propagated by the lens combination.

This embodiment is in particular advantageous in the case of the realization of light distributions with a light module, in case the requirements for the light distribution differ significantly. For example, this is the case in the case of a blinking light distribution and a high beam distribution. Due to the different requirements, different optical systems are necessary in order to generate the desired light distribution, in particular a different light decoupling optical system. However, by having both optical systems arranged in one light module, it is possible to save installation space and components in comparison to solutions with separate optical systems and/or light modules.

Further, in one embodiment, all semi-conductor light sources are arranged on a plane circuit board, which is fastened to a single-piece heat sink.

In this way, advantageously the costs for plugs, cable harness and circuit boards are significantly reduced, and all semi-conductor light sources use a common heat sink. This way the entire heat sink volume can be reduced, which saves weight and costs.

In one embodiment, the auxiliary optical system is a catadioptric optical system, and/or a reflector and/or a lens and/or an imaging lens system and/or a light guide.

Depending on the available installation space, the provided application of the light module or design requirements it is advantageous to use a different auxiliary optical system. As a result of the fact that each light source has a custom auxiliary optical system, it can be advantageous due to different requirements for the light distributions, to also use different auxiliary optical systems in one and the same light module. In principle, provision is made that also in the case of use of the same type of auxiliary optical system for all light sources this auxiliary optical system is custom designed for every light source depending on requirements.

In this connection, the auxiliary optical system may be a one-piece auxiliary optical system combination, which comprises the auxiliary optical systems of all semi-conductor light sources.

Advantageously, as a result the necessary installation space, the number of components and hence the weight and costs are further reduced.

In addition, in one embodiment, the semi-conductor light sources are arranged as a matrix in rows, wherein individual or several rows of semi-conductor light sources generate in each case at least one light distribution compliant to the rules. The rows can also be arranged offset to one another.

Also to be understood as a matrix in this context is that several semi-conductor light sources are arranged at a distance from one another in a row and that a second row of semi-conductor light sources, which are likewise arranged at a distance from one another, are positioned offset to the first row above or below it. This yields the advantage of a compact installation space. The auxiliary optical systems require a significantly larger installation space than the light sources and are thus largely responsible for the necessary installation space. Due to the offset arrangement, better use is made of the available space, since the auxiliary optical systems are also correspondingly arranged offset to one another. In this connection, in each case individual rows are provided for the generation of an individual light distribution (or a portion of a light distribution), for example one row for a passing light and one row for a high beam, which simplifies the construction. In order to save additional space, it is possible to use several rows for the generation of the same light distribution, by way of example two rows for the generation of a passing light distribution are mentioned.

In one embodiment, the diaphragm is a diaphragm surface with a combination of at least one elevation and at least one depression, wherein the elevation is arranged in the light path of a passing light source and the depression is arranged in the light path of a high beam source. The profiles of the diaphragm, in which the elevations and depressions lie, are arranged perpendicular to the main direction of light propagation.

Advantageously, as a result of this it is possible to attach light channels which require a diaphragm for the generation of a light distribution compliant to the rules to one another, such as a passing light, and to attach light channels, which do not require a diaphragm for the generation of a light distribution compliant to the rules, such as a high beam, in space saving manner in close proximity to one another. Through several elevations serving as diaphragms less space is required for the entire light module than in the case of a single large diaphragm, which has a single, continuous diaphragm edge, and through the use of a single component as a unit of several small diaphragms the number of necessary components is reduced.

Further, in one embodiment, a portion of the elevations, for example, all, with the exception of a single elevation, in each case having a stage for the generation of an image of the stage in the form of a light/dark boundary in the passing light distribution. Each stage has an edge running parallel to the main direction of propagation of the light.

Through the elevations having stages, first a bright and non-glare light distribution is generated. The channel or the channels that do not have stages are preferably designed such that they scatter the light more broadly than the channels having stages. As a result, light can for example be scattered in regions that are screened by the channels having stages. In this way a slight brightness can be generated there, which for example permits the detection of traffic signs without illegally blinding other traffic participants.

In one embodiment, an edge of the diaphragm facing the light decoupling optical system is arranged in a focal region of the auxiliary optical system and in a focal region of the projection lens system consisting of the lens combination (or the function equivalent lenses) and the light decoupling optical system (the focal regions of the lens combination (or the function equivalent lenses) and the light decoupling optical system form common focal regions which overlap with the focal region of the auxiliary optical systems).

Advantageously, in this way a sharp image of the diaphragm is projected, providing for a sharp light/dark boundary in a passing light distribution.

Further, in one embodiment, at least a lenticular part of the lens combination (or a function equivalent individual lens) in the light beam is assigned to precisely one auxiliary optical system.

This embodiment is particularly advantageous in the case of the use of several light sources, because then the contribution of every light source to the total light distribution can be customized through the design of the associated part. This also provides the opportunity, in the case of otherwise unchanged light modules, to generate specified changes of the light distribution through changes to the refractive surfaces of the lens combination (or of the function equivalent individual lenses).

In one embodiment the first partial optical element of the light decoupling optical system is a cylindrical lens.

What is advantageous about this embodiment is the simple production and compact design, which simultaneously offers a broad light exit surface.

In one embodiment, the additional partial optical element of the light decoupling optical system is a structured disk and/or a cushion optical system and/or consists of a subsurface scattering material, thus a material in which case the scattering occurs at least not only on the surface, but rather also on scattering centers lying in the volume.

This results in a widely scattered light distribution, which, for example is suitable for a blinking light distribution compliant to the rules.

In one embodiment, a portion of the light module, which generates a daytime running light distribution compliant to the rules, also generates a blinking light distribution compliant to the rules.

In one embodiment, light functions which have a similar light distribution use the same components of the light module, worthy of mention in particular here is the light decoupling optical system.

This results in a more compact design of the light module with a simultaneous reduction in costs. Compliant to the rules daytime running light- and blinking light distributions both illuminate a similar angular region. It is therefore expedient to use at least in part the same components within the light module for the generation of these two light distributions.

In one embodiment the light decoupling optical system is a single-piece component.

Along with the reduced costs for the component the installation space is also reduced and the assembly is simplified.

Further, in one embodiment, at least one vertical diaphragm is arranged in the light path of at least one high beam source and limits the angular region of the high beam source.

Advantageously, as a result the realization of a partial high beam is conceivable, in which case individual light sources are switched off or dimmed to prevent the blinding of traffic participants.

In one preferred embodiment, the light module has at least one passing light channel and at least one high beam channel, wherein each passing light channel consists of a light source, an auxiliary optical system gathering and concentrating a light of this light source and a projection lens system, that consists of a lenticular part of a lens combination or an individual lens of the lens combination and a light decoupling optical system, wherein each part of the lens combination, or each individual lens of the lens combination in the light beam is assigned to precisely one auxiliary optical system and wherein an auxiliary optical system-side focal distance of the projection lens system in each high beam channel is greater than in each passing light channel.

In one embodiment, at least two passing light channels have a different diaphragm shape, so that different light distributions can be generated by switching between channels or by a suitable dimming of each channel, for example a light distribution optimized for the motorway or for the city or for right-hand traffic or for left-hand traffic. The shifting or the dimming occurs via a corresponding activation of the light sources of the channels.

In one embodiment, at least two passing light channels have a different diaphragm shape.

In addition, in one embodiment, the light decoupling optical system is arranged or bent around a vertical axis.

Advantageously, therewith external conditions, for example the sweep of the cover disk of the headlight can be taken into account.

In one embodiment, a control unit of the headlight controlling the semi-conductor light sources acts to dim semi-conductor light sources that are used for the generation of a high beam distribution compliant to the rules, in order to generate and/or supplement a daytime running light compliant to the rules.

Advantageously, as a result the illuminating surface of the headlight is enlarged in daytime running light operation, which further improves the visibility of the motor vehicle. A further advantage lies in the fact that an assembly used only for the generation of a daytime running light distribution can be omitted.

In one embodiment, the light module, in particular the circuit board, on which the semi-conductor light sources are arranged, and the control unit controlling the semi-conductor light sources individually activate the semi-conductor light sources individually or in groups, for example dimming.

Advantageously, this makes it possible to also switch on or switch off individual light sources depending on the traffic situation, traffic type or legal requirements, as a result of which functions for increasing safety, for example a static bending light working without moving parts or a partial high beam, can be realized or requirements characteristic of a country can be met.

Additional advantages arise from the following description, the drawings and the subsidiary claims. It should be understood that the foregoing features and the features still to be explained in the following can be used not only in the respective specified combination, but rather also in other combinations or alone without exceeding the scope of the present invention.

Exemplary embodiments of the invention are presented and more closely explained in the following description.

BRIEF DESCRIPTION OF THE DRAWINGS

In the process, the figures show the following, in each case in schematic form.

DETAILED DESCRIPTION OF THE INVENTION

Figure 1:
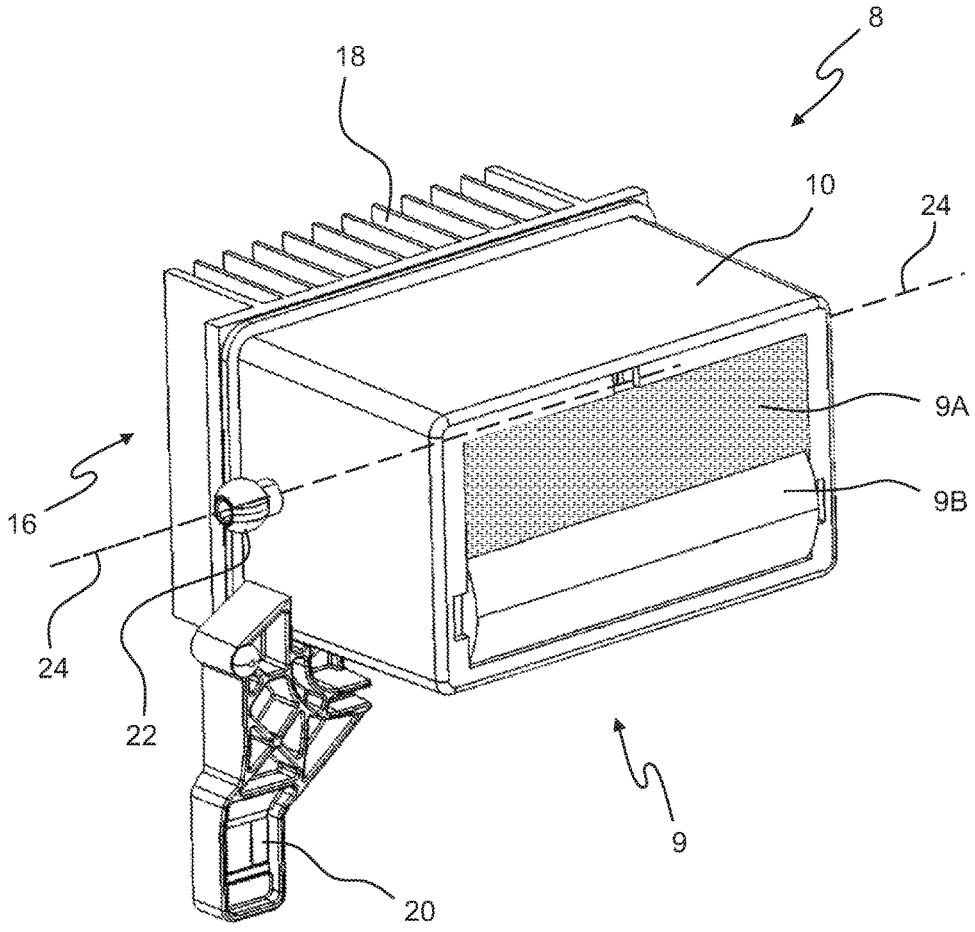
FIG. 1 shows an exemplary embodiment of an inventive light module in a three-dimensional view with housing.

In the process, the same reference numerals in different figures designate the same elements or elements that are at least comparable in function.

Specifically, FIG. 1 shows an inventive light module 8 of a motor vehicle headlight, which in this exemplary execution is presented with its housing 10. On the front of the housing 10 of the light module a light decoupling optical system 9 is formed by a partial optical element 9B and a further partial optical element 9A. The further partial optical element 9A in the shown exemplary embodiment is a structured disk, and the partial optical element 9B in the shown exemplary embodiment is a cylindrical lens. The further partial optical element 9A is arranged in a beam path of a daytime running light distribution and/or navigation light distribution, while the partial optical element 9B is arranged in the beam path of a passing light distribution and/or high beam distribution. Preferred are a cylindrical lens and structured disk, in each case individually or as a unit of a single-piece component, which lowers the number of individual parts and with it the costs for production. The light module shown here and described in the following is an advantageous further development of the invention and is able to generate at least two different light distributions compliant to the rules.

On the rear of the housing 10 of the light module 8 there is a heat sink 16, which in the shown representation form has several cooling fins 18.

In addition, a side arm is fastened on the underside of the housing 10 for the mechanical headlight range control unit 20. Through a suspension 22 laterally fastened on the housing 10 a rotational axis 24 of the headlight range control unit is defined. An actuator not shown in the figure engages below on the side arm, which swivels the side arm and with it the entire light module 8 on the plane perpendicular to the rotational axis 24.

Figure 2:
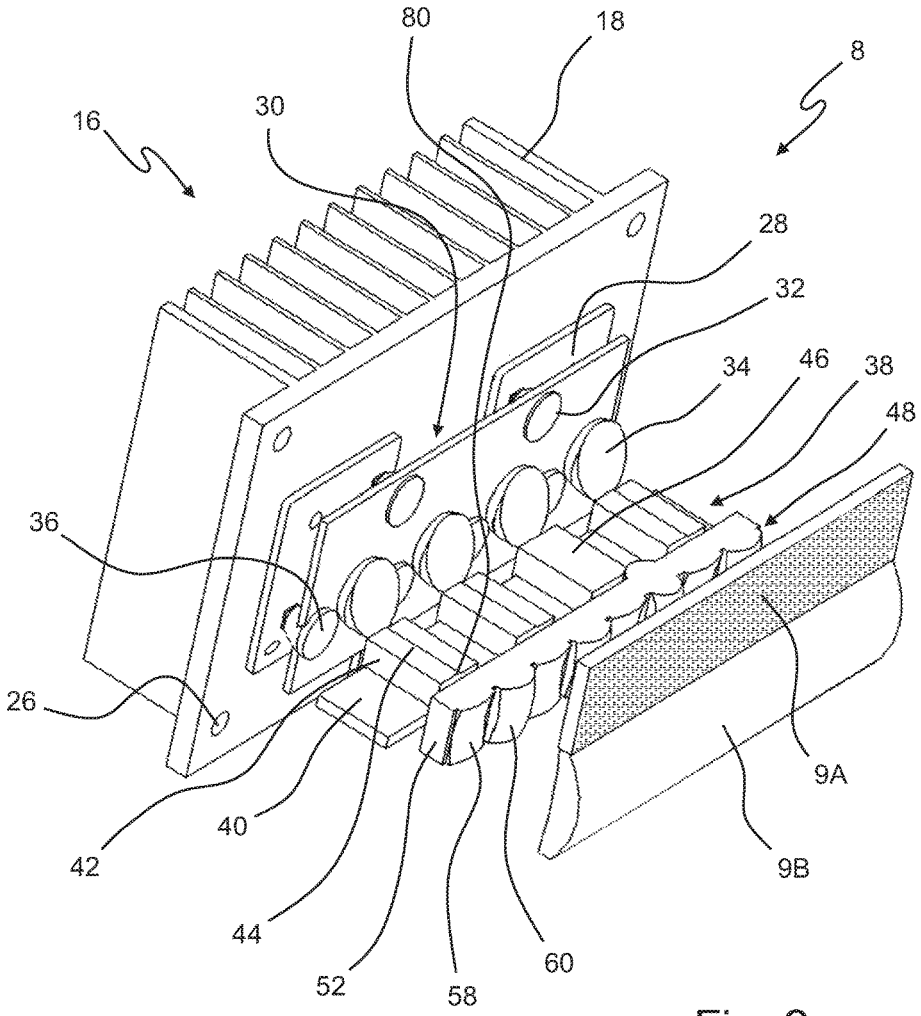
FIG. 2 shows the light module from FIG. 1 in a three-dimensional view without the housing.

FIG. 2 shows the inventive light module 8 from FIG. 1 without the housing. The heat sink 16 with its ribs 18 has boreholes 26, which are intended for the fastening of other components, for example such as the housing 10 not shown in the figure. Between the heat sink 16 and the light decoupling optical system 9 formed by the structured disk and the cylindrical lens there are further components, which are intended for the generation of a light distribution compliant to the rules.

A circuit board 28 is fastened directly to the heat sink 16, upon which the semi-conductor light sources 70 not shown in this representation, preferably LEDs, are located. In front of the circuit board 28 an auxiliary optical system combination 30 is fastened, which consists of several daytime running light auxiliary optical systems 32, passing light auxiliary optical systems 34 and high beam auxiliary optical systems 36. These individual parts of the auxiliary optical system combination 30 are arranged in the auxiliary optical system combination 30 such that each individual part in the case of an appropriate use of the auxiliary optical system combination 30 forms a custom auxiliary optical system for an individual semi-conductor light source 70 on the circuit board 28. In this connection the passing light auxiliary optical systems 34 and the high beam auxiliary optical systems 36 are in each case arranged in a row alternately next to one another. The daytime running light auxiliary optical systems 32 are located in a further row above the passing light- and high beam auxiliary optical systems 34 and 36.

In the light path according to the auxiliary optical system combination 30 there is a diaphragm combination 38, which acts as a diaphragm for the passing light distribution. The diaphragm combination 38 has several alternating depressions 40 and elevations 42, which are arranged perpendicular to the main direction of light propagation such that in each case a depression and an elevation alternate. The elevations form the diaphragms for the respective light channels. The elevations 42 are arranged in the beam paths of the passing light auxiliary optical systems 34, and the depressions 40 are arranged in the beam paths of the high beam auxiliary optical systems 36. In three of the four shown elevations a stage 44 is discernible in the diaphragm surface. These stages 44 are used for the generation of a stage in the light/dark boundary of a passing light distribution compliant to the rules. One of the four elevations 42 in the shown exemplary embodiment has a surface 46 without stage, which however does not constitute a significant feature of the invention.

In principle, it is possible to also use several individual diaphragms in place of a diaphragm combination 38. To reduce the number of components of the light module 8, an embodiment in the form of a single-piece diaphragm combination is to be preferred. In addition, in principle it is also possible that the diaphragm combination along the main direction of light propagation is only narrow (e.g. like the narrow side of a metal sheet that is e.g. less than 1 mm thick), so that the elevations and depressions only constitute parts of a contoured edge of a thin metal sheet. The diaphragm can in this case also extend in vertical direction proceeding from the optically active diaphragm edge. The optically active diaphragm edge is then an upper edge of the diaphragm.

In the light path after the diaphragm combination 38 there is a lens combination 48. In the shown embodiment the lens combination 48 has, with the exception of a convex protrusion 56 on the light entry side, a plane light entry surface 50. The convex protrusion 56 absorbs light that propagates in the passing light channel, in which the associated diaphragm elevation 42 has no stage 46.

The light exit surface 52 of the lens combination in the process consists of high beam exit surfaces 58 and passing light exit surfaces 60 arranged next to one another, which are arranged such that each of the light exit surfaces is only illuminated by a combination of semi-conductor light source 70 and its auxiliary optical system. The lens combination (or its individual lenses fulfilling the optical function) preferably lies in the light path between the edge of the diaphragm and the light emission optical system and is in the process arranged such that each part or each function equivalent individual lens ideally captures all of the light beams of the light source radiating from the respective associated auxiliary optical system. In the process, in each case a passing light exit surface 60 is arranged next to a high beam exit surface 58, so that in each case two passing light channels are separated by a high beam channel lying between them and in each case two high beam channels are separated by a passing light channel lying between them. The light module is completed by the described light decoupling optical system 9, which consists of a structured disk and cylindrical lens. A different arrangement of the high beam channels and of the passing light channels is also possible, in which case the passing light channels lie next to one another without a high beam channel lying between them and/or in which case the high beam channels lie next to one another without a passing light channel lying between them.

Figure 3:
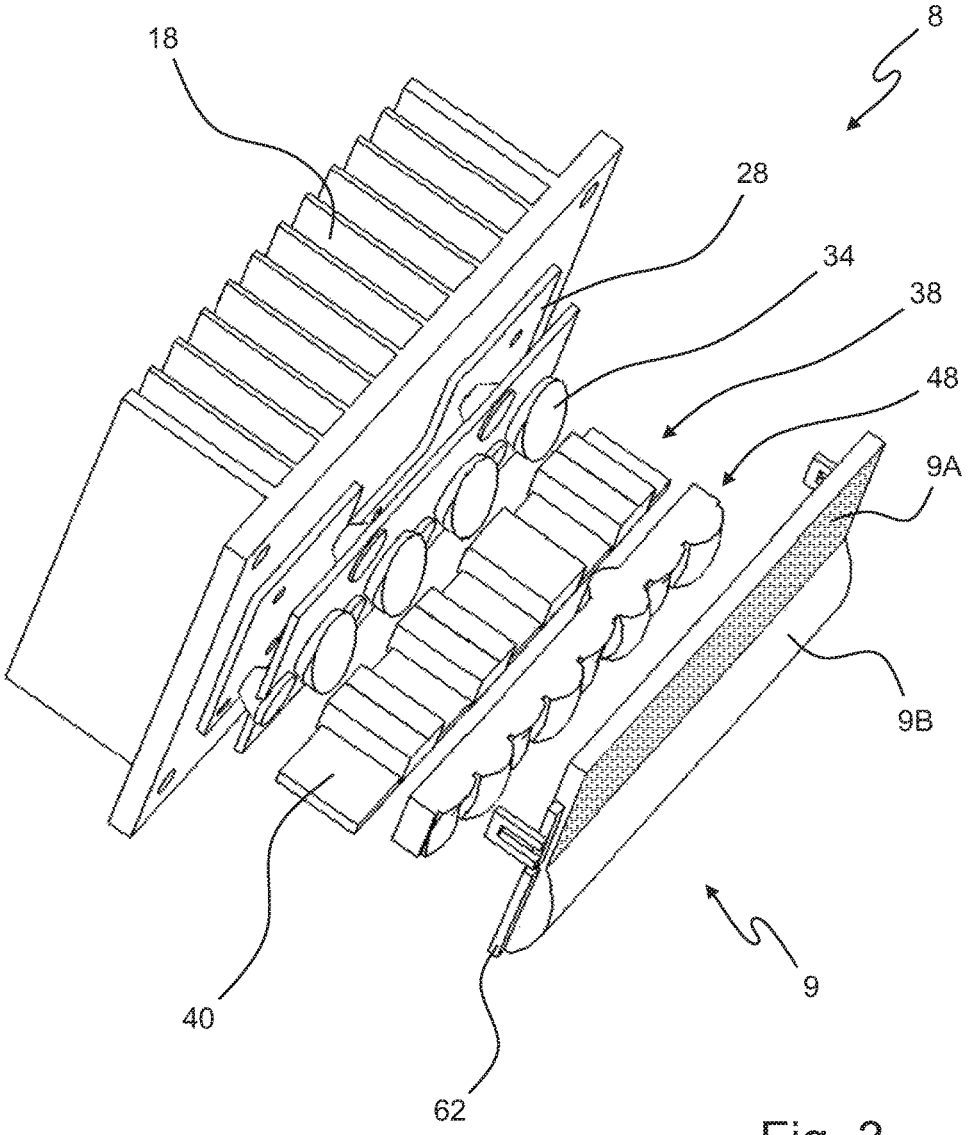
FIG. 3 shows the light module from FIG. 1 in a three-dimensional view from above.

FIG. 3 shows the light module 8 shown in FIG. 2 in a further three-dimensional view diagonally from above. From this perspective it can be discerned that the circuit board 28 lies directly (in thermal contact) on the heat sink 16 having cooling fins 18, while the auxiliary optical system combination 30, the diaphragm combination 38, the lens combination 48 and the light decoupling optical system 9 do not have to be directly adjacent to one another, but rather are arranged separately from one another by intermediate spaces lying between them.

The plane light entry surface 50 of the lens combination 48 with the convex protrusion 56 is also particularly clearly discernible, as are the different configurations of the alternately arranged high beam exit surfaces 58 and passing light exit surfaces 60 of the light exit surface 52 of the lens combination 48.

In addition, on the light decoupling optical system 9 a bracket 62 is mounted for fastening the light decoupling optical system 9 on the housing 10 of the light module 8 not shown in this figure.

Figure 4:
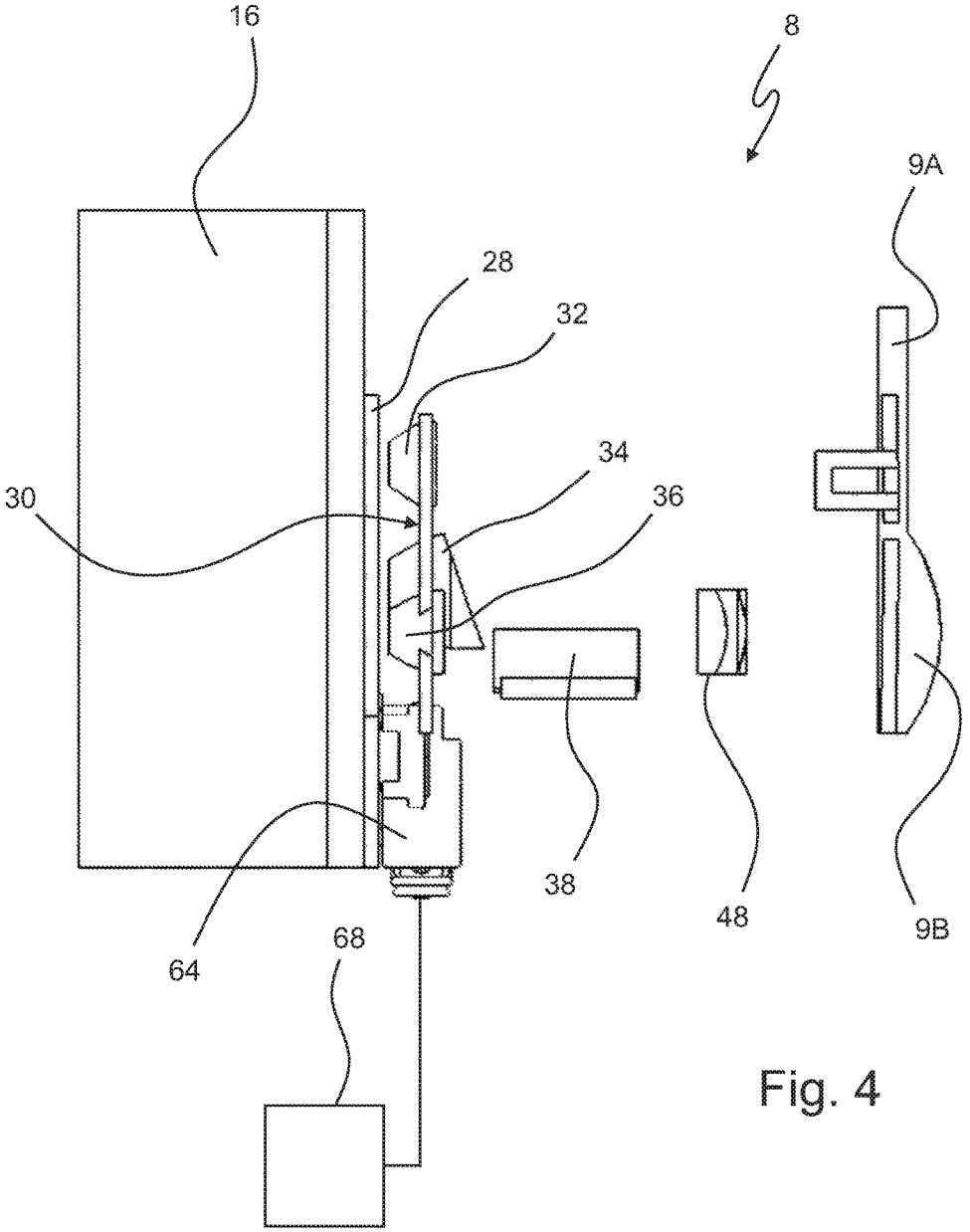
FIG. 4 shows the light module from FIG. 1 in a lateral view.

FIG. 4 shows the light module 8 consisting of heat sink 16, circuit board 28, auxiliary optical system combination 30, diaphragm combination 38, lens combination 48 and light decoupling optical system 9 consisting of structured disk (further partial optical element 9A), cylindrical lens (partial optical element 9B) and bracket 62 in a lateral view.

A connector 64 is mounted on the circuit board 28 underneath the auxiliary optical system combination 30, said connector serving as an interface for supplying power to the semi-conductor light sources 70 mounted on the circuit board and for activating the semi-conductor light sources 70 through a light control unit 68.

The different design of the individual components of the auxiliary optical system combination 30 is clearly discernible. The daytime running light auxiliary optical system 32, the passing light auxiliary optical system 34 and the high beam auxiliary optical system 36 have different designs. They differ depending on the type of light distribution to be generated, in particular in size. In addition, it can be discerned that the center points of the passing light auxiliary optical systems 34 and of the high beam auxiliary optical systems 36 are not on the same level, but rather due to the different size of the auxiliary optical systems are also arranged vertically offset to one another, so that a checkered offset arrangement arises, in which case the passing light auxiliary optical systems are in a first row and the high beam auxiliary optical systems are in a further row vertically offset to the first row. In the process, the smaller high beam auxiliary optical systems 36 are deeper than the passing light auxiliary optical systems 34.

Figure 5:
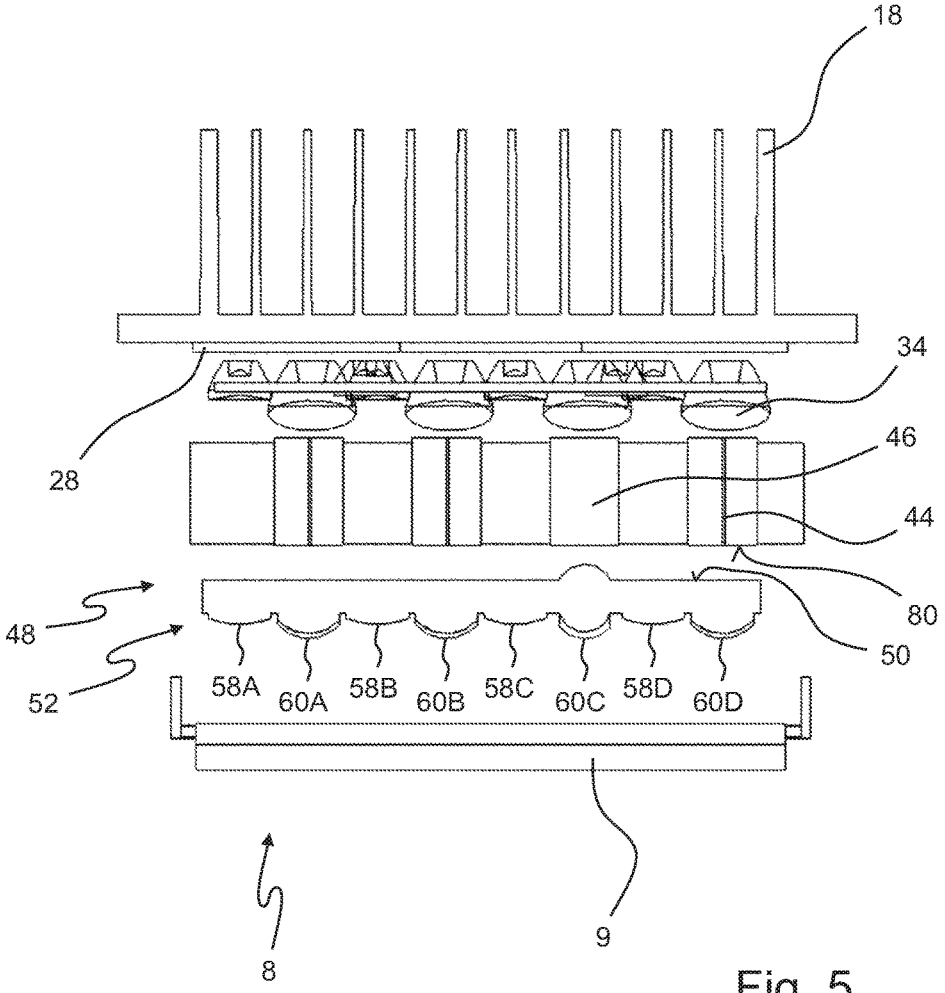
FIG. 5 shows a top view of the light module of FIG. 1.

In FIG. 5 the same light module 8 is presented in a top view. Specifically, FIG. 5 shows the heat sink 16 with cooling fins 18, circuit board 28, auxiliary optical system combination 30, diaphragm combination 38, lens combination 48 and light decoupling optical system 9 consisting of structured disk (further partial optical element 9A), cylindrical lens (partial optical element 9B) and bracket 62.

It can be discerned that a light exit surface 60C of the lens combination 48, which belongs to the light channel, in whose associated part of the diaphragm combination 38 the elevation 42 of the diaphragm combination 38 that doesn't have a stage lies, has a different shape than the other light exit surfaces 60A, 60B, 60D of the lens combination 38 for the passing light sources 74.

Since each semi-conductor light source 70 with the exception of the light decoupling optical system 9 always has its own optical system (associated part of the auxiliary optical system combination 30, associated part of the diaphragm combination 38 and associated part of the lens combination 48), individual light channels form within the light module. Corresponding to the light sources shown here, there are daytime running light channels 82, passing light channels 84 and high beam channels 86.

Figure 6:
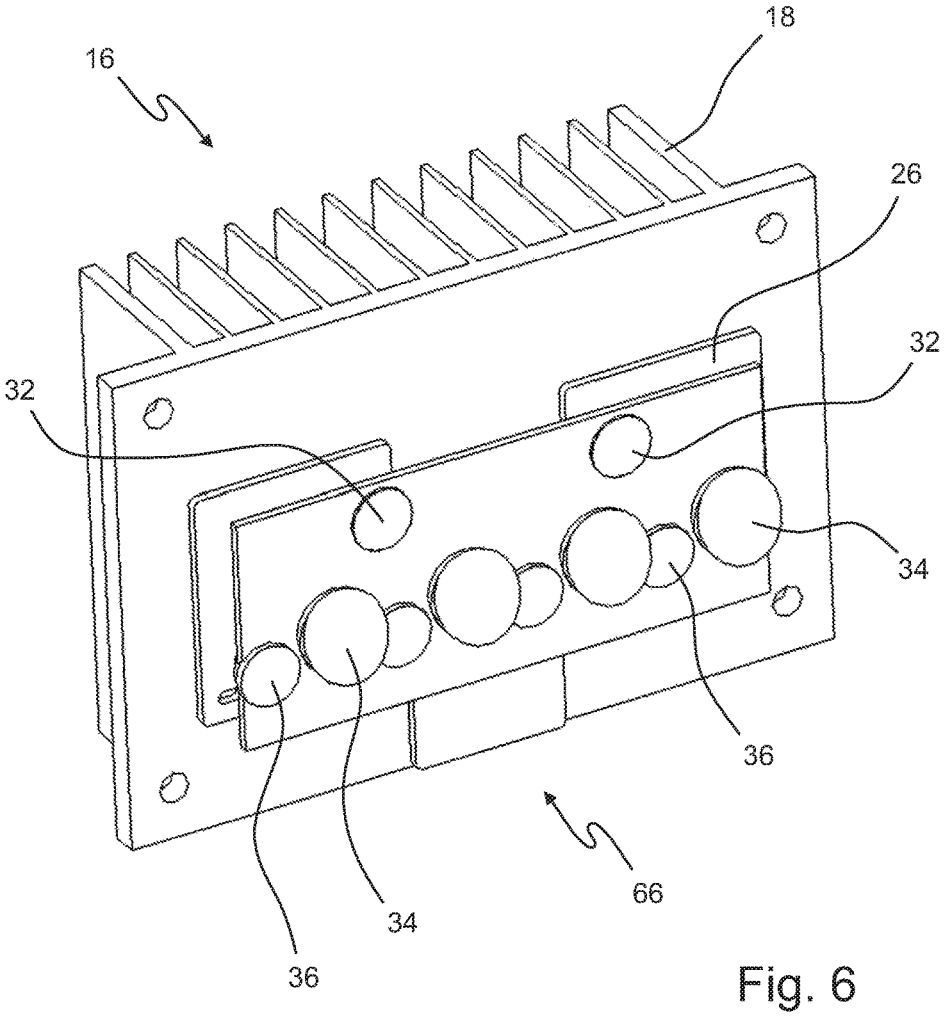
FIG. 6 shows a complex light source of the inventive light module from FIG. 1.

FIG. 6 shows a unit of heat sink 16 with cooling fins 18, circuit board 28 and auxiliary optical system combination 30 consisting of daytime running light auxiliary optical systems 32, passing light auxiliary optical systems 34 and high beam auxiliary optical systems 36 in a three-dimensional front view. This unit forms a so-called complex light source 66.

Figure 7:
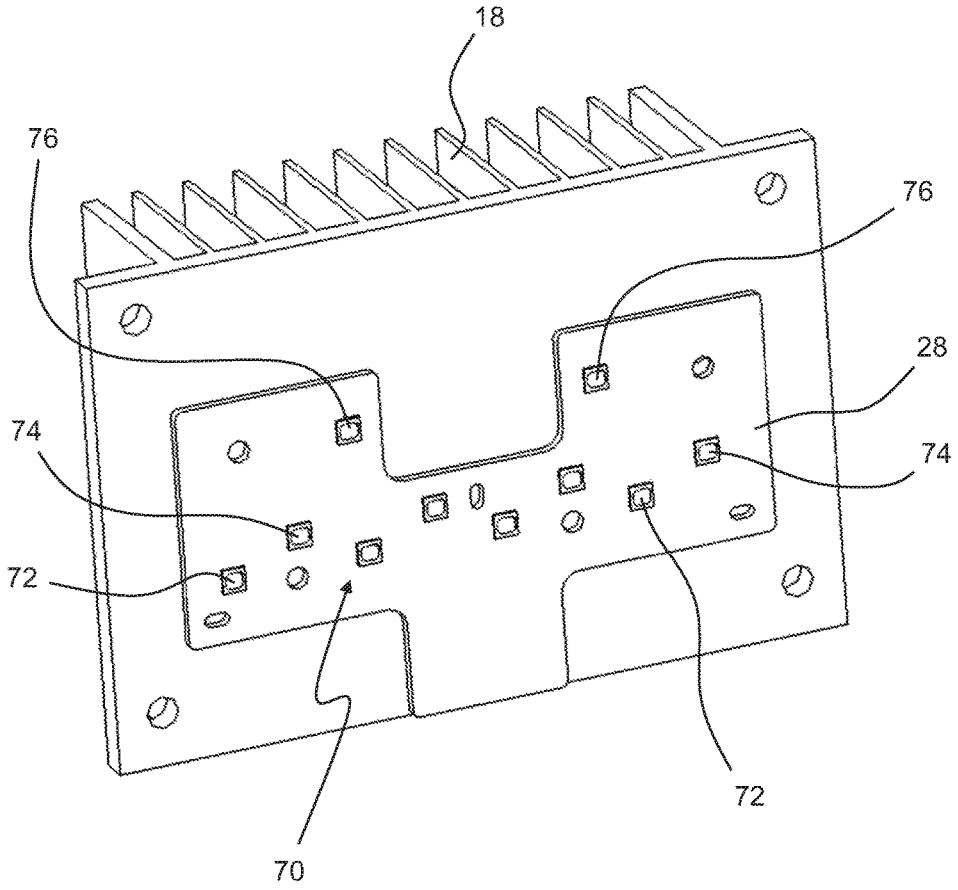
FIG. 7 shows a three-dimensional front view of the light sources on a circuit board.

In FIG. 7, as opposed to FIG. 6, the auxiliary optical system combination 30 has been removed, so that the structure of the circuit board 28 lying beneath, which is fastened on the heat sink 16, is discernible. The circuit board 28 supports several, in the present example ten, semi-conductor light sources 70. The lower row of four semi-conductor light sources are in the process high beam sources 72, the middle row has four passing light sources 74, and the upper row has the daytime running light sources 76.

For the purpose of a space-saving arrangement, the passing light sources 74 and the high beam sources 72 are arranged offset and in rows one above the other. The use of further semi-conductor light sources is also conceivable, wherein in this case, preferably further rows of alternating passing light sources 74 and high beam sources 72 are further arranged offset one above the other.

In one embodiment, the daytime running light sources 76 are also executed as blinking light sources and/or as navigation light sources. A light source can for example consist of several chips, which if necessary also emit light in different colors (for example red green and blue, in order to generate white or yellow light).

Optionally, the high beam sources 72 can also be used as additional daytime running light sources. To this end they are dimmed and not operated at full capacity, in order to prevent oncoming traffic from being blinded.

Figure 8:
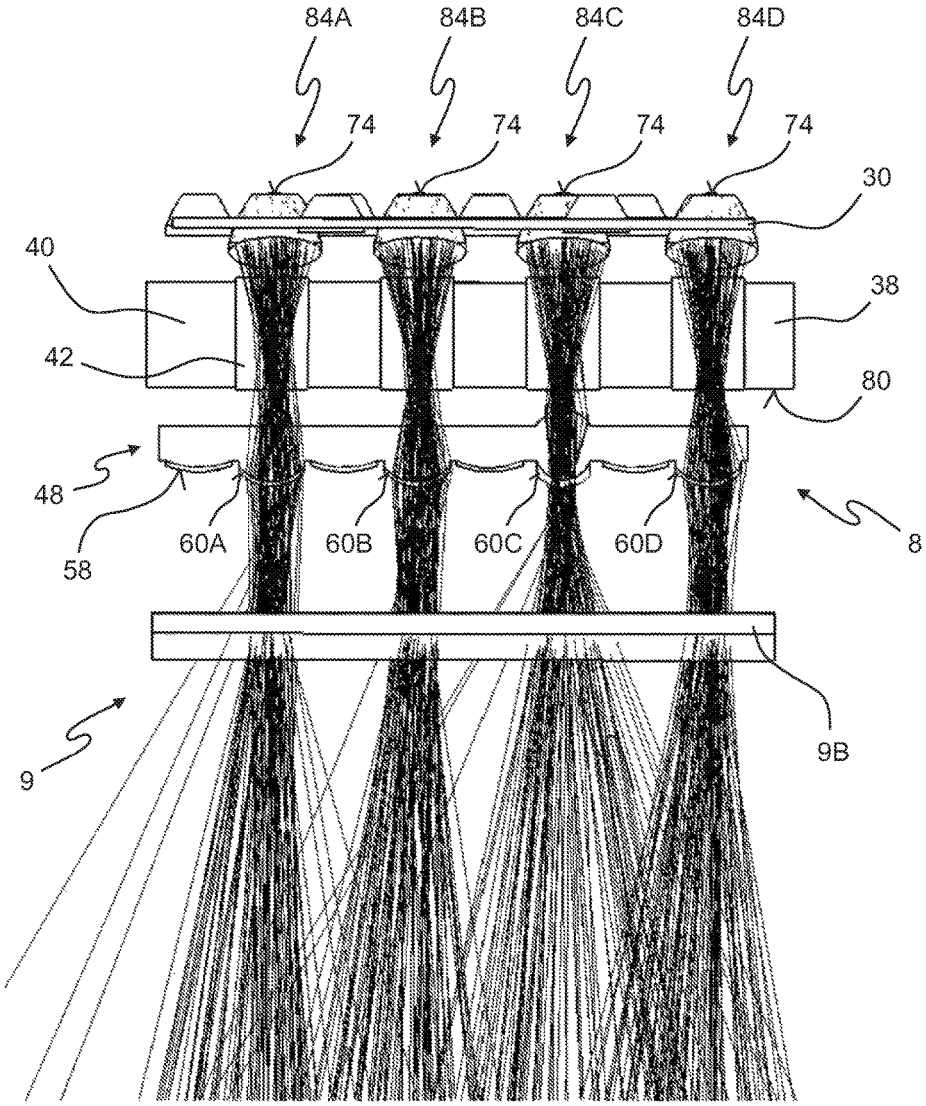
FIG. 8 shows beam paths of the passing light channels in the light module from FIG. 1 in top view.

Of course, the number of light sources shown in FIG. 8 is not restricted to the number presented there and can be adapted to the respective requirements and attendant circumstances.

In the case of the semi-conductor light sources 70, they are not necessarily light emitting diodes. For example, some or all semi-conductor light sources can also be realized by laser light sources.

FIG. 8 shows the beam paths of the four passing light channels 84. Specifically, each of the four channels has the following elements: A passing light source 74 consisting of a semi-conductor light source, a passing light auxiliary optical system 34, elevations 42 of the horizontally extending diaphragm combination 38 acting as a diaphragm, a lens combination 48 with passing light exit surfaces 60 in the form of a projection lens and a cylindrical lens as a light decoupling optical system 9B.

Light, which is generated by the passing light sources 74, is redirected and collimated by the passing light auxiliary optical system 34, in each case individually associated with a passing light source 74. The passing light source 74 and auxiliary optical system 34 are in the process arranged in vertical direction higher than the diaphragm combination 38 and direct the light diagonally from above to the diaphragm combination 38, which preferably, but not mandatorily has a mirrored surface. The focal region of the passing light auxiliary optical system 34 in the process lies on the diaphragm edge 80 of the diaphragm combination 38, said diaphragm edge 80 facing the lens combination 48. As a result, in the plane of the diaphragm edge 80 an intermediate image of a light distribution with a light/dark boundary comes into being, whose shape is determined by the shape of the diaphragm edge 80.

In three of the four light channels 84A, 84B, 84D shown in this light module the elevations 42 are provided with a stage 44, which generates a stage in the course of the light/dark boundary of the passing light distribution. A light channel 84C is focused on a part of the diaphragm edge 80, which does not have a stage 44 and correspondingly also the light/dark boundary of the passing light distribution generated by this light channel does not have a corresponding stage.

The diaphragm edge 80 lies simultaneously also in the focal region of the light entry surface 50 of the lens combination 48. While the light entry surface 50, with the exception of a convex protrusion 56 in the passing light channel 84C, is a straight and plane surface, the light exit surface 52 for every passing light channel 84A, 84B, 84C, 84D has an individual passing light exit surface 60A, 60B, 60C, 60D in the form of a projection lens. In the process, each passing light channel 84A, 84B, 84C, 84D has exactly one individual passing light exit surface 60A, 60B, 60C, 60D exclusively available.

In the presented light module 8, the lens combination 48 also has high beam exit surfaces 58, which will be described in greater detail in a description of the high beam channels 86. The high beam- and passing light exit surfaces 58 and 60 are in the process arranged alternately next to one another.

The passing light channels 84A, 84B, 84C, 84D pass through their respective associated part of the lens combination 48. The passing light exit surfaces 60 of the lens combination 48 are formed such that they concentrate greater horizontally than vertically. Therefore the part of the intermediate image generated by one of the passing light sources 74 is enlarged first and foremost in vertical direction. This contributes toward the striven for compactness of the light module 8. Due to the low horizontal installation space requirements, the semi-conductor light sources 70 can be arranged offset to one another compactly next to one another and/or in two rows one above the other and in the process in the longitudinal direction of the rows. Preferably, the lens combination (or the function equivalent individual lenses) has no curvature in vertical direction and is thus cylindrical in vertical direction. A magnification of the intermediate image, of the light distribution appearing in the diaphragm-side focal region of the light decoupling optical system in the interior of the light module occurs through the interaction of lens combination and light decoupling optical system. In the process, the magnification in horizontal direction is preferably greater than in vertical direction, wherein these directional indications always refer to an orientation as it arises in the case of an appropriate use of the light module in a motor vehicle.

Subsequently, the light emitting from the passing light sources 74 impinges on the partial optical element 9B of the light decoupling optical system 9. The partial optical element 9B here has the shape of a (horizontal) cylindrical lens, whose cylinder axis in the presented example is a horizontal perpendicular to the main direction of emission of the light module. The light issuing from the cylindrical lens generates the passing light distribution compliant to the rules.

Since the lens combination 38 is more heavily concentrated horizontally than vertically and the cylindrical lens is more heavily concentrated vertically than horizontally, a distorted image results. Thus, the vertical and horizontal image ratios are not identical. In this example the horizontal concentration is weaker than the vertical concentration. This is advantageous, because a passing light distribution typically has a width from up to 100° and a height from up to 20°. This corresponds to a width to height ratio of approximately 5:1. If such a ratio is supposed to be generated in the case of a conventional system in the intermediate image surface on the diaphragm edge 80, then the width of the diaphragm combination 38 must be designed correspondingly larger. However, the result is that the light module 8 must be wider, which is an obstacle to a compact solution. The distorted imaging projection lens system also has the effect of reducing the required installation space for the passing light channels 84A, 84B, 84C, 84D.

Each channel preferably has differences with respect to the design of the auxiliary optical system, of the elevation 42 in the diaphragm combination 38 and the passing light exit surface 60 of the lens combination 52. The overall passing light distribution only occurs through overlapping superimposition of the individual light distributions of the passing light channels 84A, 84B, 84C, 84D. Three passing light channels 84A, 84B, 84D have an elevation 42 with a stage 44. One channel 84C has an elevation 42 without a stage.

Figure 9:
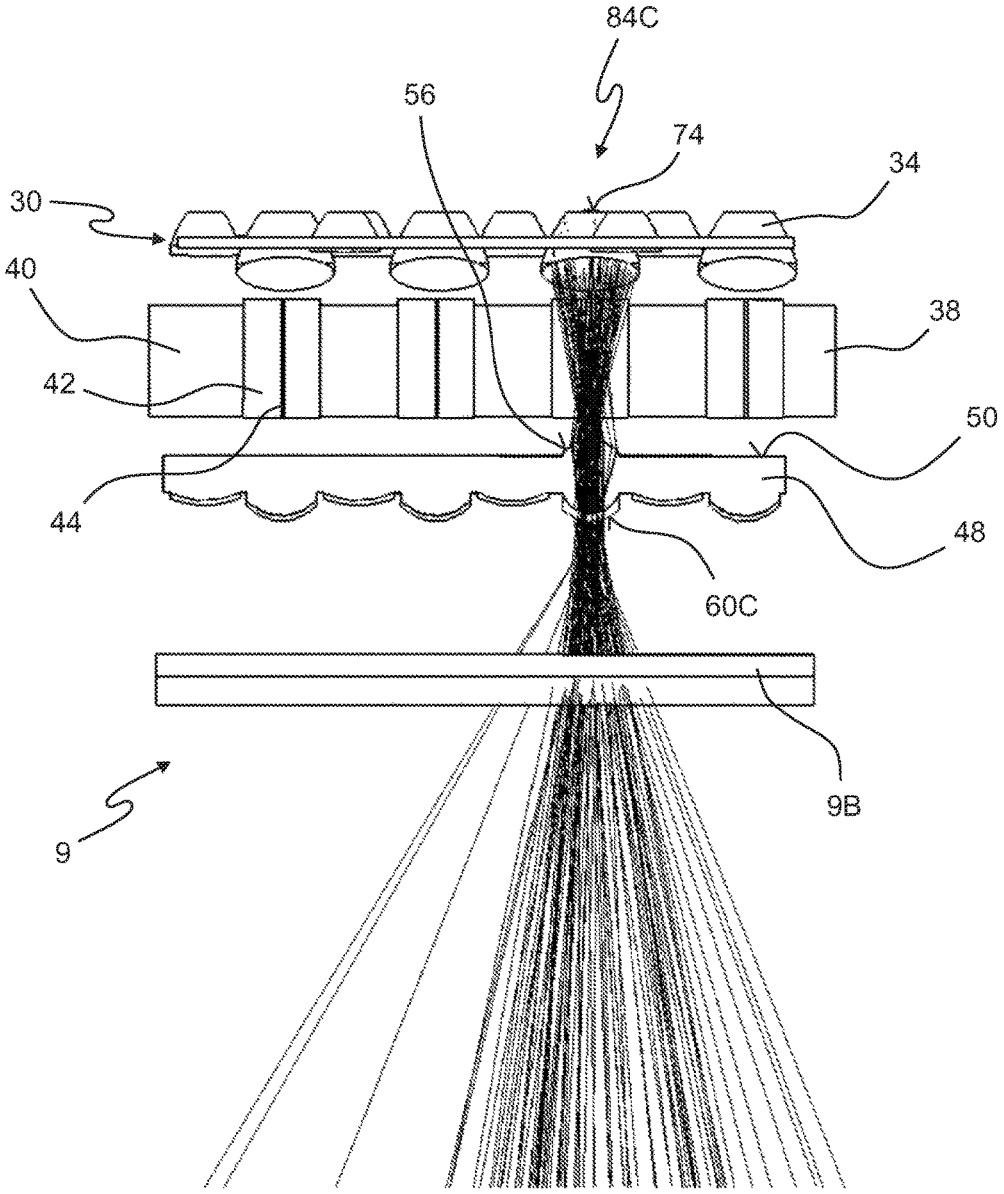
FIG. 9 shows a beam path of a passing light channel along the diaphragm not having a stage in the light module from FIG. 1.

FIG. 9 presents the beam path of the passing light channel 84C within the inventive light modules 8.

The light generated in the passing light source 74C designed as a semi-conductor light source passes through the passing light auxiliary optical system 34 of the auxiliary optical system combination 30, impinges on elevations 42 of the approximately horizontal diaphragm combination 38, passes through the lens combination 48 with passing light exit surfaces 60 in the form of a projection lens, and exits the light module through the cylindrical lens.

The light entry surface 50 of the lens combination 48 for this passing light channel 84C has the convex protrusion 56 in the form of a further projection lens, which is more curved horizontally than the light exit surface 60C of the channel. The result is that the beams are focused on a plane between light entry surface 50 and light exit surface 60C, in order to disperse again afterwards. Overall, as a result a diversification of the beams on the horizontal plane is achieved and the width of the light distribution is increased. This effect can also be achieved by having the lenses concavely bulging and hence acting horizontally as a diverging lens.

Figure 10:
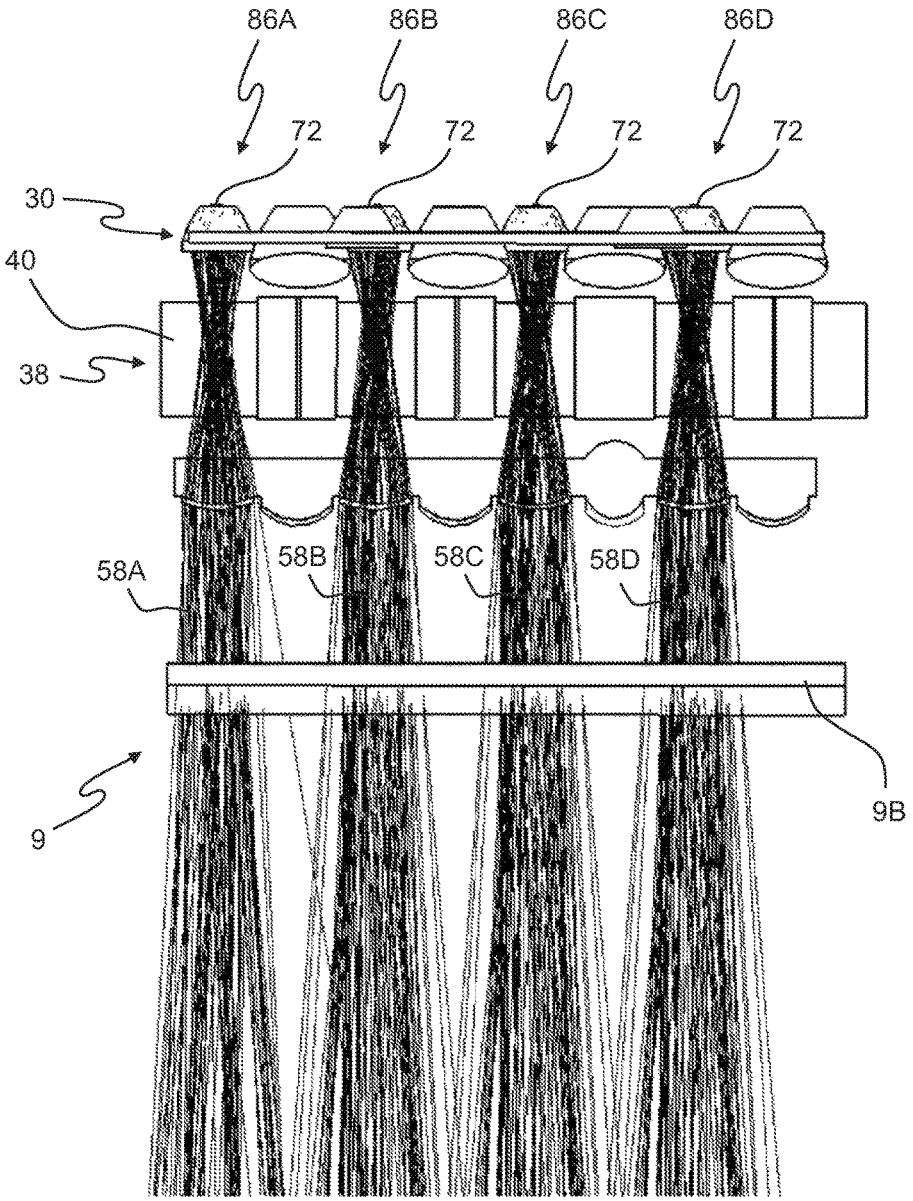
FIG. 10 shows beam paths of the high beam channels in the light module from FIG. 1.

FIG. 10 shows the beam paths of the four high beam channels 86. Specifically, each of the four channels has the following elements: a high beam source 72 consisting of a semi-conductor light source, a high beam auxiliary optical system 36 as part of the auxiliary optical system combination 30, a depression 40 in the approximately horizontal diaphragm combination 38, the lens combination 48 with high beam exit surfaces 58 in the form of a projection lens and the cylindrical lens as part of the light decoupling optical system 9.

Light, which is generated by the high beam source 72, is diverted and collimated by the auxiliary optical system 36, which in the present case is a catadioptric optical system. In the process, the high beam source 72 and auxiliary optical system 36 are located in vertical direction above the topmost surface of the depression and are configured not to the light to the surface and/or an edge of the diaphragm combination 38, which has a mirrored surface. To this end the diaphragm combination 38 has a depression 40 in each of the high beam channels 86A, 86B, 86C, 86D, so that the high beam can pass the diaphragm combination 38 unhindered, without being limited by the diaphragm.

In this connection, in each case the light channel-individual focal region of the auxiliary optical system 36 lies in the light path in front of the diaphragm edge 80 of the diaphragm combination 38 facing the light decoupling optical system 9 and overlaps with the light channel-individual focal region of the lens combination 48. While the light entry surface 50 of the high beam channels of the lens combination 48 is a straight and plane surface, the light exit surface 52 has an individual high beam exit surface 58 for each high beam channel 86A, 86B, 86C, 86D with an optically active curvature, through which the function of a projection lens results. In the process, each channel 86A, 86B, 86C, 86D has exactly one individual high beam exit surface 58A, 58B, 58C, 58D exclusively available. In the presented inventive light module 8 the lens combination 48 also has passing light exit surfaces 60, which have already been described earlier in the description of the passing light channels. The high beam- and passing light exit surfaces 58 and 60 are in the process arranged alternately next to one another. Also, the surfaces the surfaces 58 of the lens combination 48 are preferably slightly curved or not curved at all, so that they are identical or similar to a vertically oriented cylinder.

The light propagating in the high beam channels 86A, 86B, 86C, 86D passes through its respective associated part of the lens combination 48. The high beam exit surfaces 58 of the lens combination 48 are formed such that they concentrate greater horizontally than vertically. This contributes toward the striven for compactness of the light module 8. Due to the low horizontal installation space requirements the semi-conductor light sources 70 can be arranged compactly next to one another and/or offset, so two semi-conductor light sources 70 arranged adjacent to one another are separated from one another by an empty place between them.

Subsequently, the light issuing from the high beam sources 72 impinges on the partial optical element 9B. The partial optical element 9B has the shape of a cylindrical lens, whose cylinder axis in the present inventive execution is a horizontal perpendicular to the main direction of emission of the light module. A concentration of the light occurs in this cylindrical lens, preferably in vertical direction. The light exiting the cylindrical lens generates the high beam distribution compliant to the rules.

Figure 11:
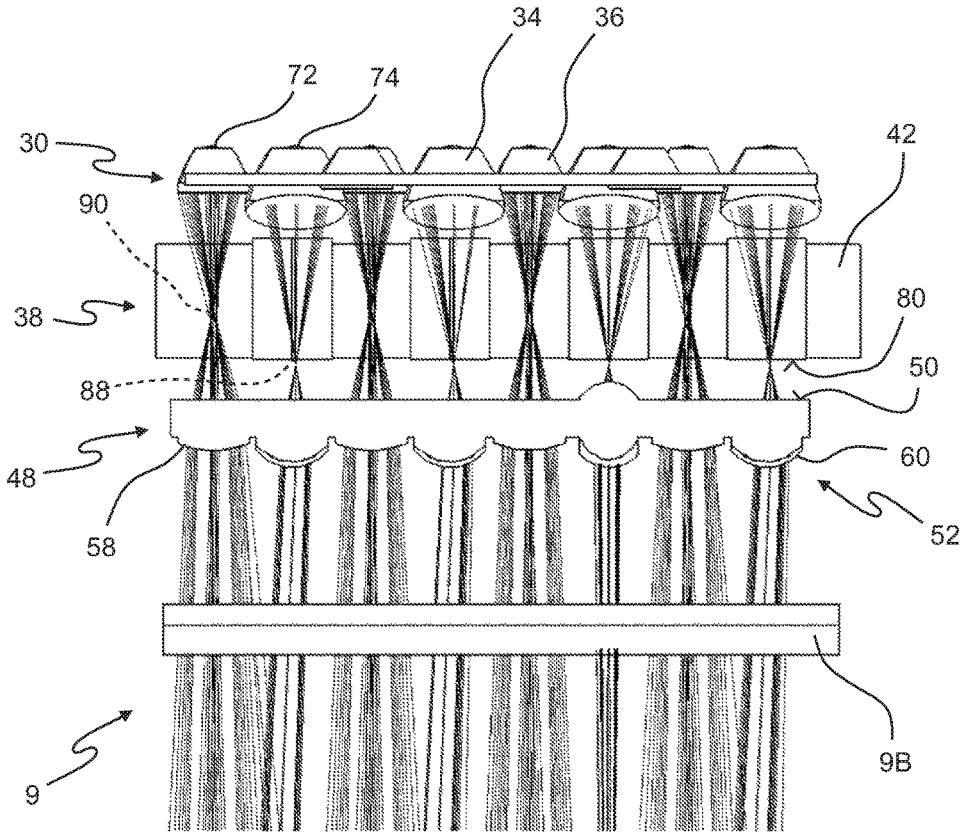
FIG. 11 shows a comparison of the beam paths of passing light and high beam in the light module from FIG. 1.

FIG. 11 presents a comparison of the four passing light channels 84 and of the four high beam channels 86, wherein for the sake of clarity, point light sources have been selected as passing light sources 74 and high beam sources 72. This shows clearly that the passing light auxiliary optical systems 34 and the high beam auxiliary optical systems 36 have different focal regions. The focal region 88 of the passing light auxiliary optical systems 34 lies in the proximity of the front edge 80 of the diaphragm combination 38, the focal region 90 of the high beam auxiliary optical systems 36 on the other hand, lies between the auxiliary optical system combination 30 and the front edge 80 of the diaphragm combination 38. As a result, the total magnification of the light module 8 for the high beam channels 86 can be designed smaller than for the passing light channels 84.

This is advantageous, since different demands are made on passing light and high beam distributions with respect to width, height and maximum light intensity. While a passing light distribution typically has a maximum width of 100° and a maximum height of 20°, a high beam distribution typically has a smaller maximum width 50° and a smaller maximum height of 10°. The ratio of width passing light to width high beam and height passing light to height high beam is thus both times about 2:1. There are also different requirements for maximum light intensity. While in the case of a passing light maximum light intensities in the magnitude of 50 lx on a wall 25 m away are typical, in the case of a high beam it is 100 lx. The ratio of the light intensity from passing light to high beam thus corresponds to a ratio 1:2. Both the ratios for height and width as well as also for the maximum light intensities require a smaller magnification for the high beam channels 86.

This can be realized through the described structure. The total magnification is determined from the product of magnification by the auxiliary optical system 30 and of the magnification by the lens combination 48. The magnification of the auxiliary optical system 30 is given by the ratio of image distance to object distance, wherein the object is a semi-conductor light source 70. In the described execution the object distance (distance semi-conductor light source to auxiliary optical system) for all parts of the auxiliary optical system combination 30 is selected approximately the same. However, in the high beam channels 86 the image distance of the high beam auxiliary optical systems 36 is selected smaller than the image distance of the passing light auxiliary optical systems 34. Thus, the magnification by the high beam auxiliary optical systems 36 is lower. Due to the shorter image distance, of necessity a greater distance between intermediate image surface and cylindrical lens is generated. As a result, the high beam exit surface 58 of the lens combination 48 is designed such that the total focal distance of the lens combination 48 in the high beam channels 86 is greater than in the passing light channels 84. Since the image distance for light channels 84 and 86 is identical (in the presented example 25 m), hence the magnification in the high beam channels 86 is also less than in the passing light channels 84.

Figure 12:
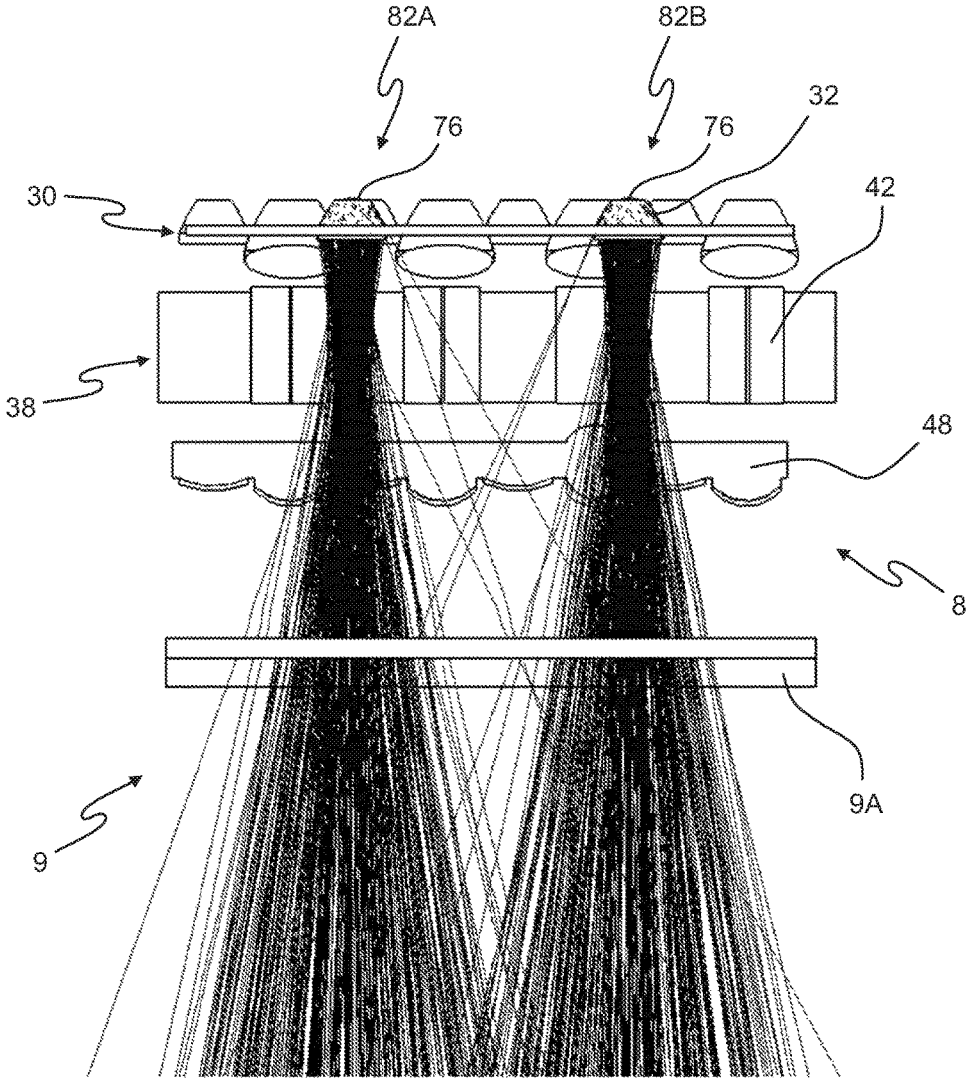
FIG. 12 shows beam paths of the daytime running light/navigation light channels in the light module from FIG. 1.

FIG. 12 shows the beam paths of the two daytime running light channels 82. Specifically, each of the two channels has the following elements: A daytime running light source 76 consisting of a semi-conductor light source, a daytime running light auxiliary optical system 32 and a structured disk 9A as part of the light decoupling optical system 9.

Light which is generated by the daytime running light source 76 is diverted and collimated by the auxiliary optical system 32, in the present case a catadioptric optical system. In the process, the light is directed in the direction of the structured disk, which serves as a further partial optical element 9A of the light decoupling optical system 9. In this connection, the disk has a structure which scatters the light in greater angular regions, in order to generate a daytime running light- and/or navigation light distribution. In this connection, it can for example be a cushion structure. Preferably, light is scattered to each part of the structured disk in similar fashion, so that a uniform, bright illumination of the disk results.

The daytime running light channels 82 can alternatively or additionally also be used as a channel for a blinking light. It is advantageous to use bright yellow semi-conductor light sources for this purpose, in particular if the channel should be used in parallel for daytime running light/navigation light. However, it is also possible to use white semi-conductor light sources and color parts of the auxiliary optical system combination 30 and/or parts of the structured disk yellow. To use the channel in parallel for daytime running light and blinking light, a white and a yellow LED can be used next to one another, or an RGB LED can be used which can be switched to white and yellow.

Figure 13:
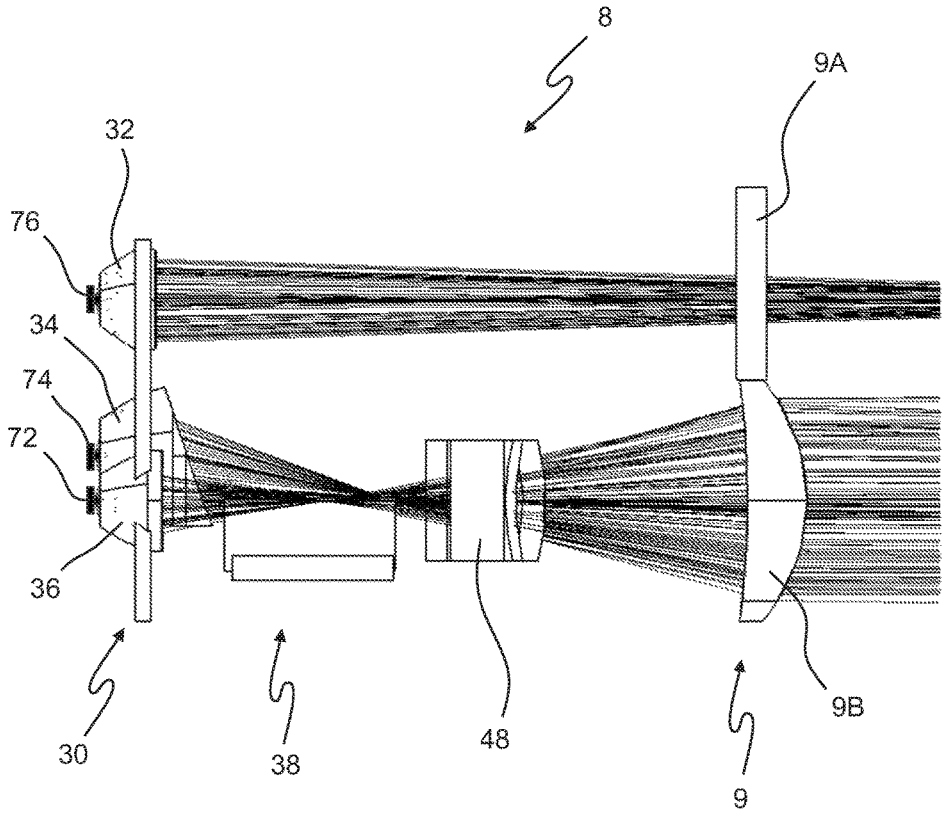
FIG. 13 shows beam paths of different light channels in the light module from FIG. 1 in a lateral view.

FIG. 13 presents a lateral view of a light module 8 with marked beam paths of a daytime running light channel 82, of a passing light channel 84 and a high beam channel 86.

The semi-conductor light sources 72, 74, 76 are all arranged on a plane to which the auxiliary optical system combination 30 consisting of daytime running light auxiliary optical system 32, passing light auxiliary optical system 34 and high beam auxiliary optical system 36 adjoins.

The daytime running light channel 82 is, in the process arranged above the other two channels. It does not pass through the diaphragm combination 38 and the lens combination 48, but rather, after exiting the daytime running light auxiliary optical system 32 the light impinges directly on the structured disk.

The passing light channel 84 and high beam light channel 86, on the other hand both pass through the diaphragm combination 38 and subsequently the lens combination 48 after their respective auxiliary optical systems 34 and 36. Finally, the two both impinge on their part of the light decoupling optical system 9, which is realized by a cylindrical lens.

Figure 14:
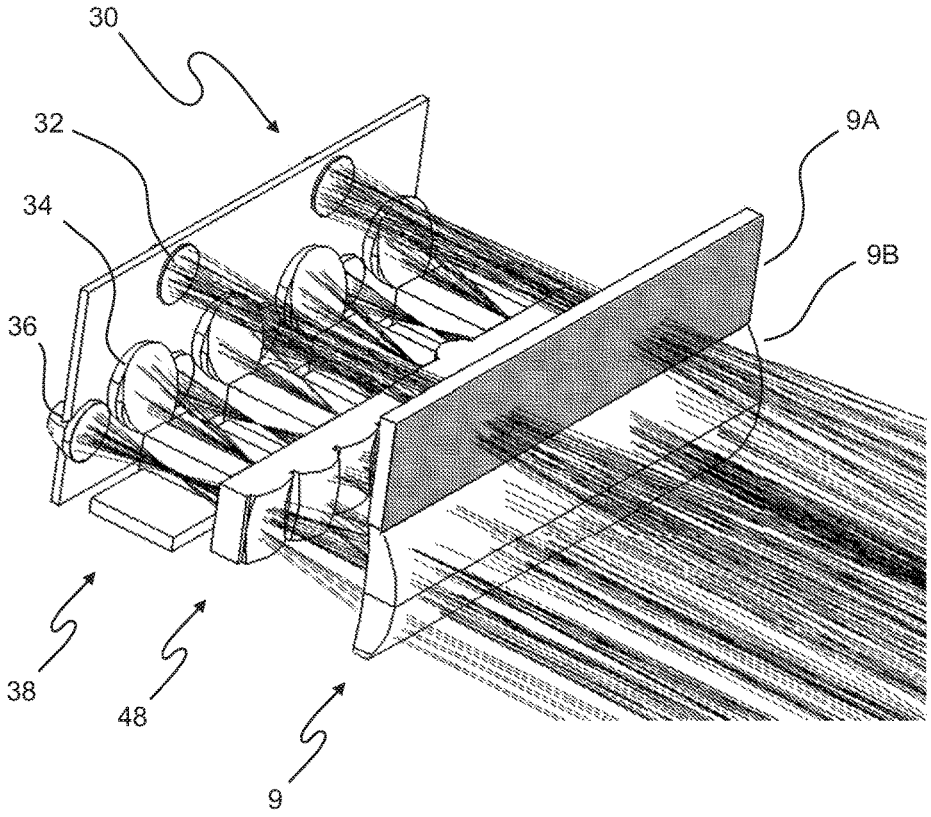
FIG. 14 shows beam paths of different light channels in the light module from FIG. 1 in a three-dimensional view.

FIG. 14 shows a further comparison of the beam paths of the daytime running light channels 82, passing light channels 84 and high beam channels 86 within an inventive light module 8 in a three-dimensional view.

The daytime running light channels 82, which are arranged above the passing light channels 84 and high beam channels 86, after exiting the auxiliary optical system combination 30 impinge directly on the structured disk, which forms a part of the light decoupling optical system 9.

Passing light channels 84 and high beam channels 86 are arranged alternately next to one another. Both pass through the diaphragm combination 38 and the lens combination 48 after exiting the auxiliary optical system combination 30. The light beams of these channels exit the light module 8 above the part of the light decoupling optical system 9, which is a cylindrical lens.

FIGS. 13 and 14 show clearly that the light module can be easily divided from its light functions into a lower part (headlight light functions such as passing light generation and high beam generation) and an upper part (signal light functions such as blinking light, daytime running light, navigation light, . . . ), wherein this functional separation is associated with the possibility of a structural separation. From the applicant's point of view, in particular the lower part forms a separate invention.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A light module for a motor vehicle headlight with at least two semi-conductor light sources, each with a custom auxiliary optical system for each semi-conductor light source, a light decoupling optical system having at least one partial optical element and a diaphragm arranged between the auxiliary optical system and the light decoupling optical system, wherein the light module generates at least two different light distributions compliant to the rules, in each case individually or in any combination, wherein between the light decoupling optical system and the diaphragm a lens combination is arranged, which is illuminated by at least one of the two semi-conductor light sources and from which light of this semi-conductor light source exits in a light beam, wherein the lens combination has a different refractivity in two spatial directions perpendicular to one another and to the main propagation direction of the light emitted from the light module and wherein the light decoupling optical system, which is arranged in the light beam of the lens combination, has a different refractivity in two spatial directions perpendicular to one another and to the main propagation direction of the light emitted from the light module, wherein the refractivity of the light decoupling optical system is greater in the spatial direction in which the lens combination has the lesser of its two refractivities and wherein the lens combination is arranged closer to the diaphragm than to the light decoupling optical system.

2. The light module as set forth in claim 1, wherein the lens combination consists of a number of individual lenses, of which each is illuminated with the light of a light source by precisely one auxiliary optical system, wherein the individual lenses are arranged in a series running perpendicular to the main direction of light propagation and wherein the light decoupling optical system consists of an individual lens assigned to all individual lenses.

3. The light module as set forth in claim 1, wherein the spatial directions, in which the light decoupling optical system and the lens combination have a different refractivity, in the case of appropriate use of the light module are a horizontal and a vertical spatial direction.

4. The light module as set forth in claim 1, wherein light emitted from the light module is a passing light and/or high beam and/or daytime running light and/or navigation light and/or blinking light and/or bending light and/or motorway light and/or town light and/or partial high beam and/or marking light compliant to the rules.

5. The light module as set forth in claim 1, wherein the light decoupling optical system has a further partial optical element and that the auxiliary optical system von at least one of the semi-conductor light sources directs light of this semi-conductor light source past the lens combination to the further partial optical element and that the further partial optical element generates a light distribution which is different from the light distributions of the light which is propagated by the lens combination.

6. The light module as set forth in claim 1, wherein all semi-conductor light sources are arranged on a plane circuit board which is fastened on a single-piece heat sink.

7. The light module as set forth in claim 1, wherein the auxiliary optical system is a catadioptric optical system, and/or a reflector and/or a lens and/or an imaging lens system and/or a light guide.

8. The light module as set forth in claim 1, wherein the auxiliary optical system is part of a single-piece auxiliary optical system combination which comprises the auxiliary optical systems of all semi-conductor light sources.

9. The light module as set forth in claim 1, wherein the semi-conductor light sources are arranged as a matrix and wherein individual or several rows of semi-conductor light sources commonly generate in each case at least one light distribution compliant to the rules.

10. The light module as set forth in claim 1, wherein the diaphragm is a diaphragm combination of at least one elevation and at least one depression, wherein the elevation is arranged in the light path of a passing light source and the depression is arranged in the light path of a high beam source.

11. The light module as set forth in claim 1, wherein a portion of the elevations have a stage for the generation of a stage in a light/dark boundary in the passing light distribution.

12. The light module as set forth in claim 1, wherein an edge of the diaphragm facing the light decoupling optical system is arranged in a focal region of the auxiliary optical system and in a focal region of a projection lens system consisting of the lens combination and the light decoupling optical system.

13. The light module as set forth in claim 1, wherein at least one lenticular part of the lens combination or an individual lens of the lens combination in the light beam is assigned to precisely one auxiliary optical system.

14. The light module as set forth in claim 1, wherein the first partial optical element of the light decoupling optical system is a cylindrical lens.

15. The light module as set forth in claim 1, wherein the additional partial optical element of the light decoupling optical system is a structured disk and/or a cushion optical system and/or is made of a subsurface scattering material.

16. The light module as set forth in claim 1, wherein a part of the light module assigned to the partial optical element, generates a daytime running light distribution compliant to the rules also generates a blinking light distribution compliant to the rules.

17. The light module as set forth in claim 1, wherein the light decoupling optical system is a single-piece component.

18. The light module as set forth in claim 1, wherein at least one vertical diaphragm is arranged in the light path at least one high beam source and limits the illuminated angular region of the high beam source.

19. The light module as set forth in claim 1, wherein the light module has at least one passing light channel and at least one high beam channel, wherein each passing light channel has a light source, an auxiliary optical system gathering and concentrating a light of this light source and a projection lens system, which consists of a lenticular part of a lens combination or an individual lens of the lens combination and a light decoupling optical system, wherein each part of the lens combination, or each individual lens of the lens combination in the light beam is assigned to precisely one auxiliary optical system and wherein an auxiliary optical system-side focal distance of the projection lens system in each high beam channel is greater than in each passing light channel.

20. The light module as set forth in claim 19, wherein at least two passing light channels have a different diaphragm shape.

* * * * *